US009796543B2

(12) United States Patent
Sato

(10) Patent No.: US 9,796,543 B2
(45) Date of Patent: Oct. 24, 2017

(54) FEEDING APPARATUS AND IMAGE FORMING SYSTEM INCLUDING THE SAME

(71) Applicants: CANON FINETECH INC., Misato-shi, Saitama (JP); NISCA CORPORATION, Minamikoma-gun, Yamanashi (JP)

(72) Inventor: Yasushi Sato, Minamikoma-gun (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 15/215,897

(22) Filed: Jul. 21, 2016

(65) Prior Publication Data

US 2017/0031296 A1 Feb. 2, 2017

(30) Foreign Application Priority Data

Jul. 29, 2015 (JP) ..... 2015-149148

(51) Int. Cl.

| | |
|---|---|
| ***B65H 1/22*** | (2006.01) |
| ***B65H 1/26*** | (2006.01) |
| ***B65H 3/66*** | (2006.01) |
| ***B65H 3/06*** | (2006.01) |
| ***B65H 1/00*** | (2006.01) |
| ***G03G 15/00*** | (2006.01) |

(52) U.S. Cl.

CPC ..... *B65H 1/266* (2013.01); *B65H 1/00* (2013.01); *B65H 3/06* (2013.01); *B65H 3/66* (2013.01); *G03G 15/6502* (2013.01); *G03G 15/6511* (2013.01); *B65H 2405/31* (2013.01); *B65H 2405/32* (2013.01); *B65H 2405/324* (2013.01)

(58) Field of Classification Search

CPC ... B65H 1/00; B65H 1/04; B65H 1/08; B65H 1/14; B65H 1/26; B65H 1/266; B65H 2402/32; B65H 2405/31; B65H 2405/312; B65H 2405/32; B65H 2405/324

See application file for complete search history.

(56) References Cited

U.S. PATENT DOCUMENTS

| | | | | |
|---|---|---|---|---|
| 5,348,284 A * | 9/1994 | Ishihama | ..... | B65H 1/04 248/612 |
| 6,341,932 B1 * | 1/2002 | Otsuji | ..... | B65H 1/04 271/9.08 |
| 9,010,748 B2 | 4/2015 | Hamasaki | | |

(Continued)

FOREIGN PATENT DOCUMENTS

| | | |
|---|---|---|
| JP | 04-16429 A | 1/1992 |
| JP | 06-144600 A | 5/1994 |

(Continued)

*Primary Examiner* — Prasad Gokhale

(74) *Attorney, Agent, or Firm* — Fitzpatrick, Cella, Harper & Scinto

(57) ABSTRACT

A feeding apparatus configured to feed a sheet, the feeding apparatus including: a placement unit on which the sheet is placed, the placement unit being movable in an intersecting direction intersecting with a sheet feeding direction; a feeding unit configured to feed the sheet placed on the placement unit in the sheet feeding direction; and a first guide unit and a second guide unit configured to guide the placement unit in the intersecting direction, wherein the first guide unit is disposed below the feeding unit and the second guide unit and downstream of the second guide unit in the sheet feeding direction.

20 Claims, 6 Drawing Sheets

(56) References Cited

U.S. PATENT DOCUMENTS

| | | | | |
|---|---|---|---|---|
| 2003/0113148 | A1* | 6/2003 | Hoene | B65H 1/14 399/391 |
| 2011/0318079 | A1* | 12/2011 | Sakamoto | B65H 1/266 399/388 |
| 2014/0021680 | A1* | 1/2014 | Hamasaki | B65H 1/00 271/147 |
| 2014/0203496 | A1* | 7/2014 | Hamasaki | B65H 7/06 271/18 |
| 2016/0122141 | A1* | 5/2016 | Tomaru | B65H 1/08 271/126 |

FOREIGN PATENT DOCUMENTS

| | | | |
|---|---|---|---|
| JP | 07-285683 | A | 10/1995 |
| JP | 07-285693 | A | 10/1995 |
| JP | 09-20434 | A | 1/1997 |
| JP | 10-171196 | A | 6/1998 |
| JP | 2000-255797 | A | 9/2000 |
| JP | 2000-351460 | A | 12/2000 |
| JP | 2000351460 | A | 12/2000 |
| JP | 2014-019533 | A | 2/2014 |

* cited by examiner

FEEDING APPARATUS AND IMAGE FORMING SYSTEM INCLUDING THE SAME

BACKGROUND OF THE INVENTION

Field of the Invention

The present invention relates to a feeding apparatus configured to feed a sheet and an image forming system including the same.

Description of the Related Art

Hitherto, there has been known a feeding apparatus configured to supply a sheet to an image forming unit of an image forming apparatus such as a copying machine, or a printer. The feeding apparatus includes a storage unit configured to store sheets.

The sheet storage unit in the feeding apparatus is configured to be pulled out from a housing of the feeding apparatus to an operation side to allow replenishment of sheets. In detail, inner rails extending parallel to each other are provided at the same height position on opposed side surfaces of the storage unit, respectively, and outer rails configured to guide the respective inner rails are provided on a housing side. The storage unit is pulled out from the housing by sliding the inner rails along the outer rails.

In the feeding apparatus having the storage unit described above, there has been a case where, when a user moves the storage unit with respect to the housing, the storage unit and a bundle of sheets stacked in the storage unit are shifted due to an inertia force. In such a case, there is a risk of causing problems such as occurrence of failures in components of the feeding apparatus.

SUMMARY OF THE INVENTION

According to one embodiment of the present invention, there is provided a feeding apparatus configured to feed a sheet, the feeding unit comprising:

a placement unit on which the sheet is placed, the placement unit being movable in an intersecting direction intersecting with a sheet feeding direction;

a feeding unit configured to feed the sheet placed on the placement unit in the sheet feeding direction; and a first guide unit and a second guide unit configured to guide the placement unit in the intersecting direction, wherein the first guide unit is disposed below the feeding unit and the second guide unit and downstream of the second guide unit in the sheet feeding direction.

According to another embodiment of the present invention, there is provided a feeding apparatus configured to feed a sheet, the feeding apparatus comprising:

a placement unit movable in upward and downward directions with the sheet being placed on the placement unit, the placement unit being movable in an intersecting direction intersecting with a sheet feeding direction;

a moving unit configured to move the placement unit in an upward direction; and a first guide unit and a second guide unit configured to guide the placement unit in the intersecting direction, wherein the first guide unit is disposed below the moving unit and the second guide unit.

Further features of the present invention will become apparent from the following description of exemplary embodiments with reference to the attached drawings.

DESCRIPTION OF THE EMBODIMENTS

Figure 1:
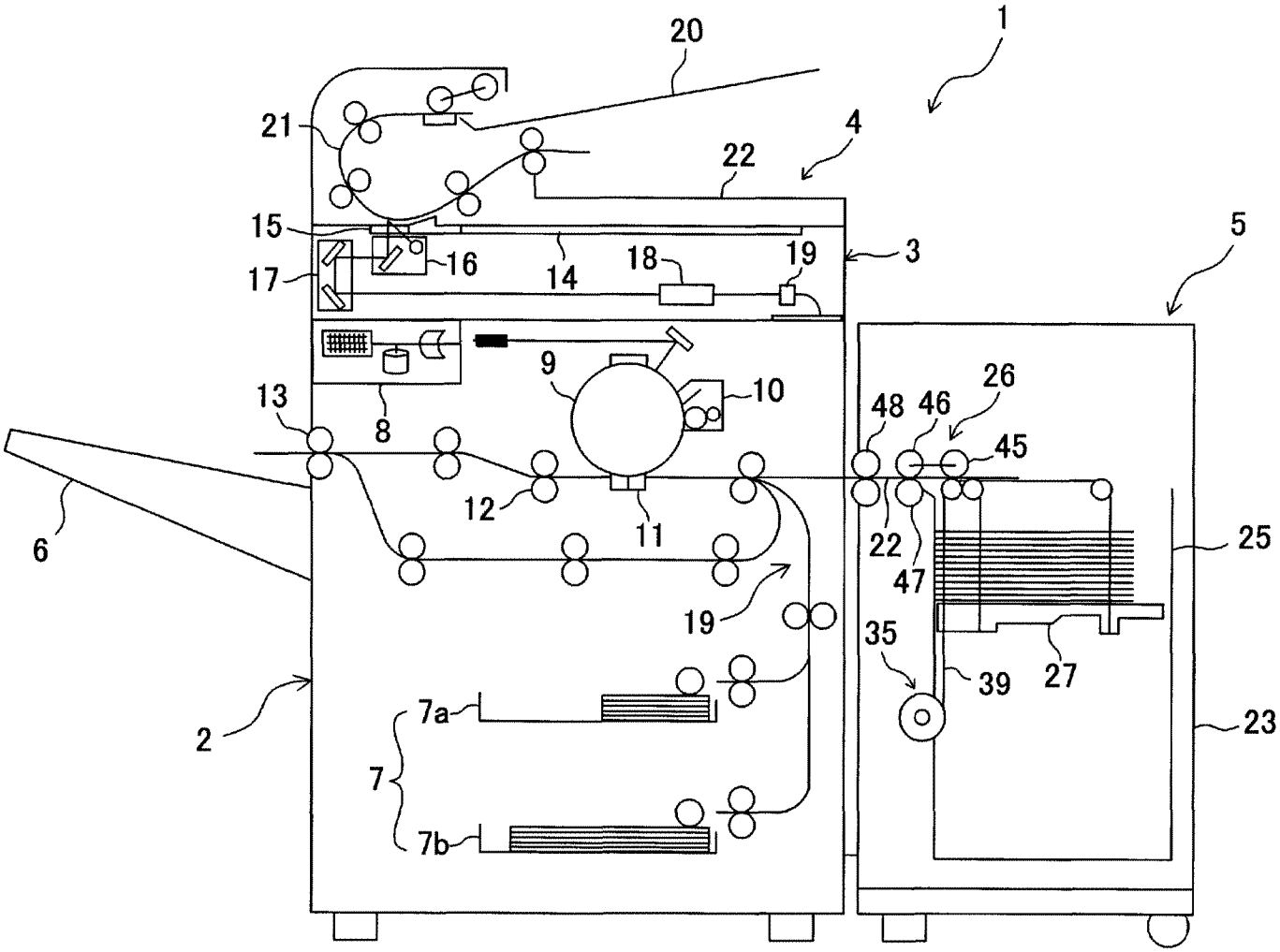
FIG. 1 is an explanatory view for illustrating an overall configuration of an image forming system including a feeding apparatus according to one embodiment of the present invention.

Now, an embodiment of the present invention will be described in detail with reference to the attached drawings. In the following description in the specification, "a width direction of a sheet" represents a direction which is perpendicular to a feeding direction of a sheet from a feeding apparatus 5 to an image forming apparatus 2.

First, an overall configuration of an image forming system 1 will be described with reference to FIG. 1. The image forming system 1 includes an image forming apparatus 2, a document reading apparatus 3, a document feeding apparatus 4, a feeding apparatus 5, and a sheet collecting apparatus 6. The image forming apparatus 2 includes feeding cassettes 7 each configured to store about 100 sheets (two feeding cassettes 7*a* and 7*b* are provided in the embodiment illustrated in FIG. 1). The image forming apparatus 2 performs an image forming operation, which is based on image data read from an image of a document by the document reading apparatus 3, onto a sheet supplied from any one of the feeding cassette 7*a*, the feeding cassette 7*b*, and the feeding apparatus 5. The sheet on which the image has been formed is collected and stored on the sheet collecting apparatus 6. The document can be fed to the document reading apparatus 3 also by the document feeding apparatus 4.

The image forming apparatus 2 is only necessary to form an image on a sheet, and hence various image forming mechanisms may be employed. In the embodiment illustrated in FIG. 1, an image forming mechanism of an electrophotographic type, that is, an electrostatic image forming mechanism is employed as an image forming mechanism. However, the image forming mechanism of the image forming apparatus 2 is not limited to the electrostatic image forming mechanism, and various mechanisms such as an ink jet image forming mechanism and an offset image forming mechanism may also be employed.

The image forming apparatus 2 illustrated in FIG. 1 includes an exposure device (such as a laser head) 8, a photosensitive drum 9, a developing unit 10, a transfer charger 11, and a fixing roller 12. An electrostatic latent image (static image) is formed on a surface of the photosensitive drum 9 by the exposure device 8. The developing unit 10 allows toner (image ink) as a developer to adhere onto the electrostatic latent image. The toner adhering on the photosensitive drum 9 is transferred by the transfer charger 11 onto a sheet which is fed from the feeding cassette 7*a*, the feeding cassette 7*b*, or the feeding apparatus 5. The sheet carrying the toner transferred thereon is sent to the fixing roller 12 disposed on downstream, and the toner carried on the sheet is heated and fixed. After that, the sheet is delivered to the sheet collecting apparatus 6 by a sheet delivery roller pair 13.

On top of the document reading apparatus 3, there are provided a first platen 14 and a second platen 15, which are made of transparent glass, juxtaposed in a horizontal direction. The first platen 14 is used for reading a document set thereon by hand, and is formed to have such a size as to enable placement of a document having an applicable maximum size. The second platen 15 is used for reading a document which is fed from the document feeding apparatus 4 and moved at a predetermined speed.

In the document reading apparatus 3, there are provided a first reading carriage 16, a second reading carriage 17, a condensing lens 18, and a photoelectric conversion unit including a photoelectric conversion element 19. The first reading carriage 16 and the second reading carriage 17 are driven by a carriage motor (not shown) to reciprocate in a sub scanning direction under the first platen 14. The first reading carriage 16 is provided with a lamp configured to irradiate light to a document, and a mirror configured to reflect light reflected from the document. The second reading carriage 17 is provided with two mirrors configured to guide the light from the mirror of the first reading carriage 16 to the condensing lens 18 and the photoelectric conversion element 19. When a document placed on the first platen 14 is to be read, light is irradiated from the first reading carriage 16 to an image of the document placed on the first platen 14 while the first reading carriage 16 and the second reading carriage 17 are moved. Light reflected from the document is guided to the photoelectric conversion element 19 through the first reading carriage 16 and the second reading carriage 17 and converted into an electric signal. Accordingly, image data is generated from the document. The image data generated in such a manner is transmitted as an image signal to the exposure device 8 of the image forming apparatus 2.

The document feeding apparatus 4 includes a feeding tray 20, a sheet conveyance mechanism 21, and a sheet delivery tray 22. Documents placed on the feeding tray 20 are conveyed one after another by the sheet conveyance mechanism 21, passed above the second platen 15, and delivered to the sheet delivery tray 22. When a document that is fed from the document feeding apparatus 4 and passed above the second platen 15 is to be read, the first reading carriage 16 and the second reading carriage 17 are stopped in advance under the second platen 15, and image data is generated from the document passed above the second platen 15.

Figure 2:
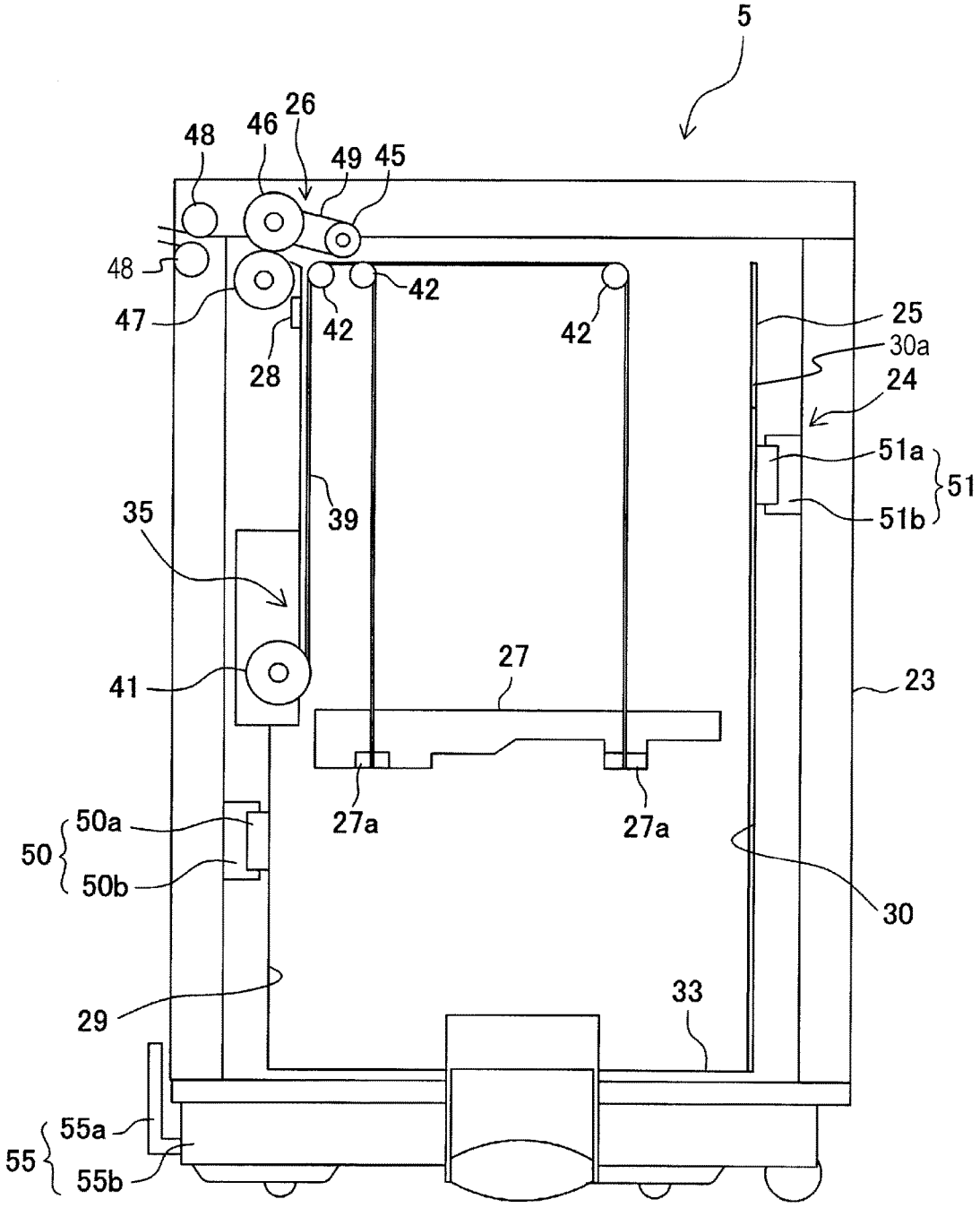
FIG. 2 is an explanatory view for illustrating an internal configuration of the feeding apparatus illustrated in FIG. 1.
Figure 3:
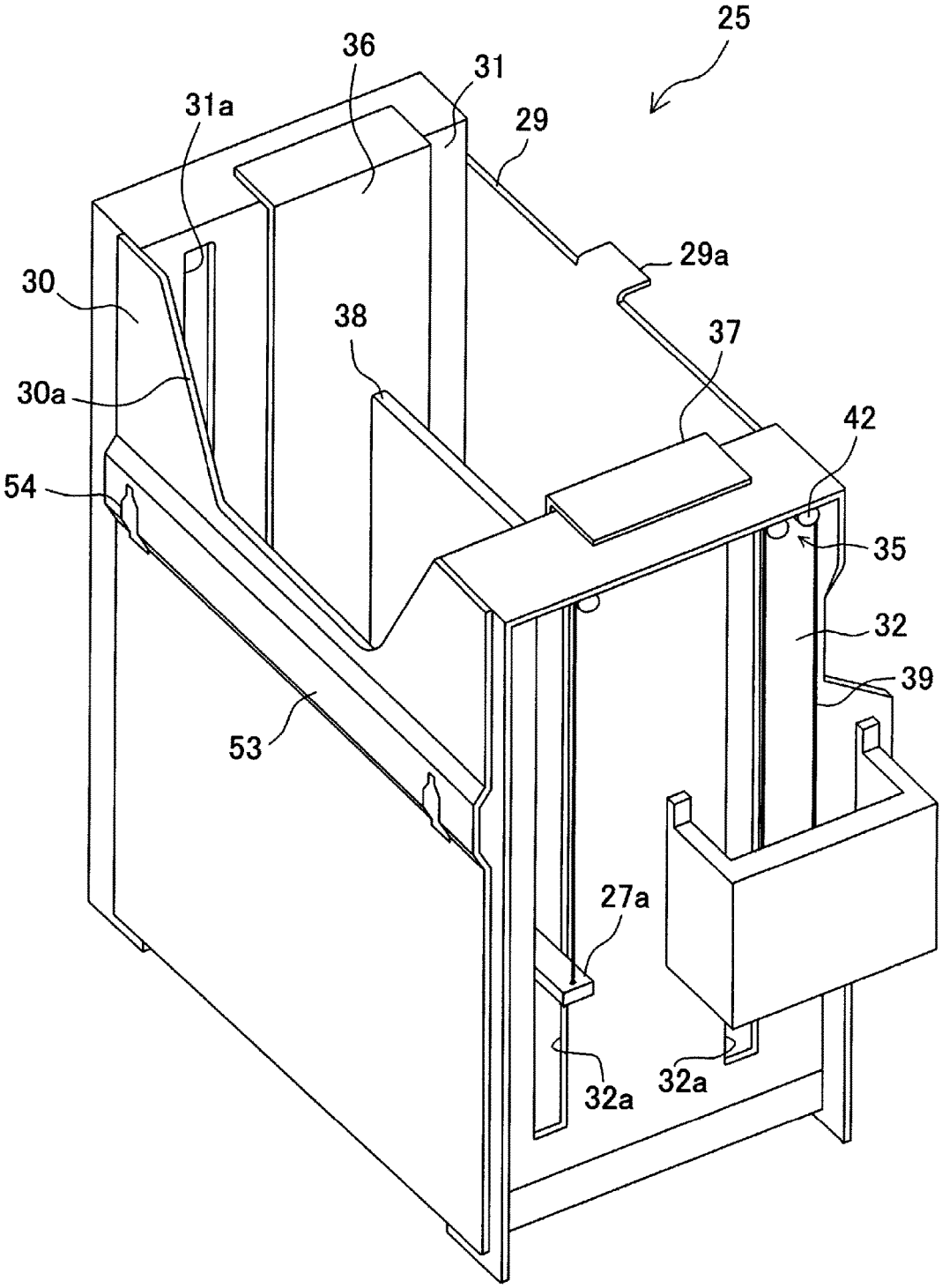
FIG. 3 is a perspective view for illustrating a storage unit of the feeding apparatus illustrated in FIG. 1.

Next, with reference to FIG. 2 to FIG. 4, the structure of the feeding apparatus 5 will be described in detail. The feeding apparatus 5 includes a housing (feeding apparatus body) 23, a storage unit 25 configured to store sheets as a storage portion which is supported by a pull-out mechanism 24 in the housing 23 so as to be pulled out, and a separating and feeding mechanism 26 configured to separate the sheets stored in the storage unit 25 one by one and feed the sheet to the image forming apparatus 2. In the storage unit 25, there is provided a stacking tray 27 which is configured to be raised and lowered in an up-and-down direction and serves as a placement unit on which the sheets are placed. The stacking tray 27 comprises a plate-like member having a flat surface. The sheets can be stacked on the stacking tray 27. Further, at an upper part of the storage unit 25, there is provided a sheet upper surface detection sensor 28 configured to detect a position of an uppermost surface of sheets stacked on the stacking tray 27.

The storage unit 25 has a substantially box-like shape having an opening on top. When the storage unit 25 is pulled out from the housing 23, sheets can be charged and stacked on the stacking tray 27 in the storage unit 25 through the opening. A space (hereinafter, referred to as "stacking tray storing space") for storing the stacking tray 27 in the storage unit 25 is partitioned by a left side wall portion 29 and a right side wall portion 30 which are opposed to each other in a feeding direction (which is a direction of feeding a sheet from the feeding apparatus 5 to the image forming apparatus 2, and a direction from the right side to the left side in FIG. 2), a near side wall portion 31 and a far side wall portion 32 which are opposed to each other in a width direction of a sheet (a direction perpendicular to the feeding direction), and a bottom plate 33. An outer side of the near side wall portion 31 is further covered with an exterior member 34. The left side wall portion 29 and the right side wall portion 30 are located on the left side and the right side respectively when viewed from a side toward which the storage unit 25 is pulled out. The near side wall portion 31 and the far side wall portion 32 are located on the near side and the far side, respectively, when viewed from the side toward which the storage unit 25 is pulled out.

On top of the left side wall portion 29, there is formed a guide slope part 29*a* configured to guide sheets stacked on the stacking tray 27 to downstream (in detail, to a nip portion formed between a feeding roller 46 and a separating roller 48 of the separating and feeding mechanism 26 described later), and a sheet can be smoothly guided from the stacking tray 27 to the separating and feeding mechanism 26. On top of the right side wall portion 30, there is formed a cut-out portion 30*a*. Forming the cut-out portion 30*a* facilitates charging and stacking of sheets onto the stacking tray 27 in the storage unit 25.

In outer regions of the near side wall portion 31 and the far side wall portion 32, there is provided a lift mechanism 35 configured to raise and lower the stacking tray 27. Moreover, elongated slots 31*a* extending in the up-and-down direction are formed in the near side wall portion 31, and elongated slots 32*a* extending in the up-and-down direction are formed in the far side wall portion 32. Support parts 27*a* protruding and extending sideward (the width direction of a sheet) from both side portions of the stacking tray 27 facing the width direction of a sheet penetrate and extend through the slots 31*a* and 32*a*, respectively. These support parts 27*a* are supported by the lift mechanism 35 provided in the outer regions of the near side wall portion 31 and the far side wall portion 32. Driving of the lift mechanism 35 causes the support parts 27*a* to be moved along the slots 31*a* and 32*a* respectively, and the stacking tray 27 on which the sheets are stacked is raised and lowered while maintaining a substantially horizontal state of the stacking tray 27.

Figure 4:
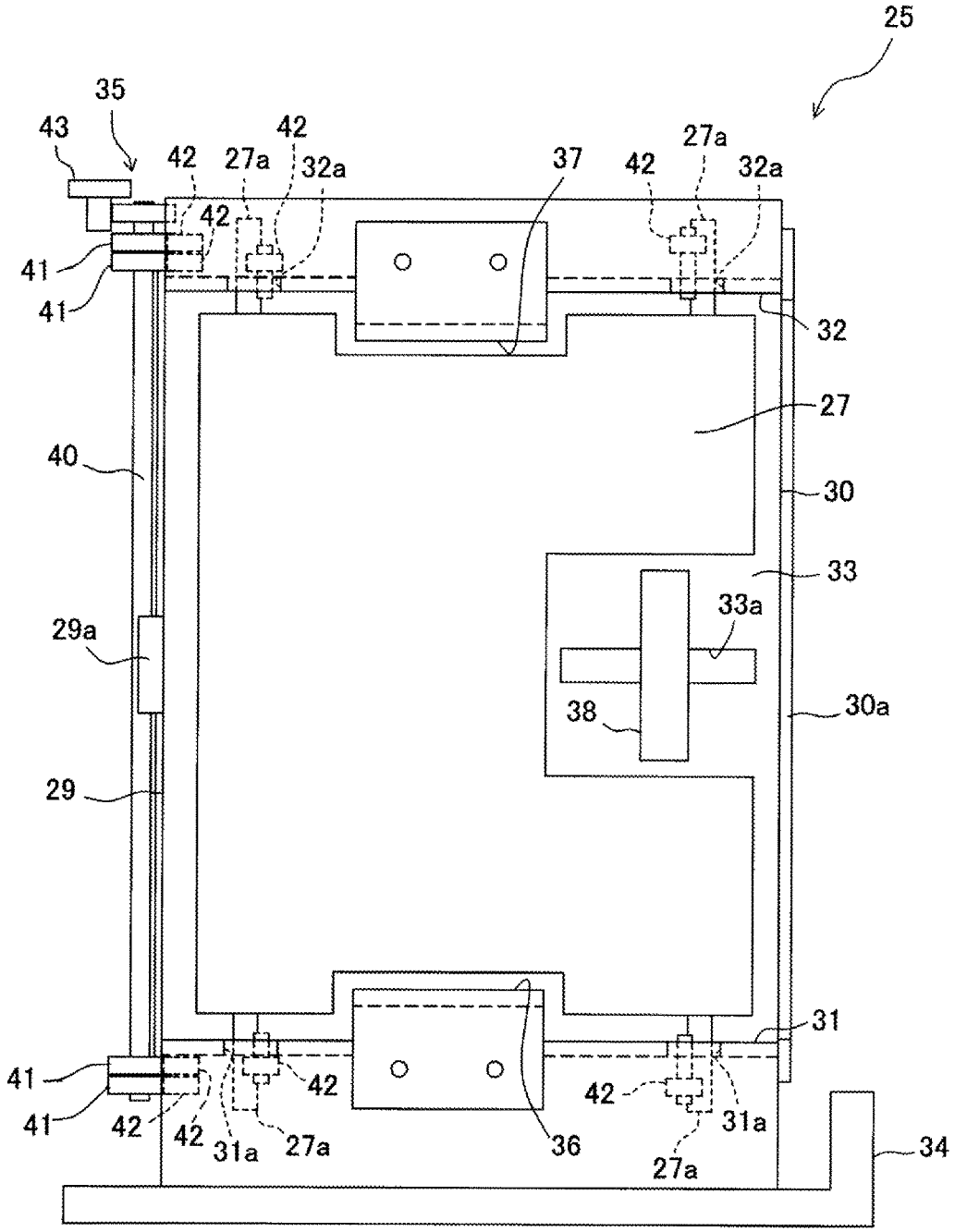
FIG. 4 is an explanatory view for illustrating the storage unit of the feeding apparatus illustrated in FIG. 1 as viewed from above.

In the embodiment, as illustrated in FIG. 4, the four support parts 27*a* are provided so as to extend sideward from the vicinity of four corners of the stacking tray 27, respectively. The near side wall portion 31 has two slots 31*a* formed at positions corresponding to two support parts 27*a* located on the side of the near side wall portion 31, and the far side wall portion 32 has two slots 32*a* formed at positions corresponding to two support parts 27*a* located on the side of the far side wall portion 32. However, the number of the support parts 27*a* of the stacking tray 27 is not limited to four, and any number may be employed as long as the stacking tray 27 can be raised and lowered by the lift mechanism 35 while maintaining the substantially horizontal state of the stacking tray 27. Further, the number of the slots is also not limited to four, and may be changed in accordance with the number of the support parts 27*a*.

In the stacking tray storing space, there are further provided side edge restricting members 36 and 37, which are located so as to interpose the sheets stacked on the stacking tray 27 between the side edge restricting members 36 and 37 in the width direction, and a trailing edge restricting member 38, which is located on a trailing edge side (an end on a side far from the image forming apparatus 2 in the feeding direction) of the sheets on the loading tray 27. The position of the sheets in the width direction on the stacking tray 27 is restricted by the side edge restricting members 36 and 37, and the position of the sheets in the feeding direction on the stacking tray 27 is restricted by the left side wall portion 29 (the side wall portion 29 on the forward side in the feeding direction) of the storage unit 25 and the trailing edge restricting member 38. In the illustrated embodiment, as illustrated in FIG. 4, the side edge restricting member 36 and the side edge restricting member 37 are mounted to the upper surfaces of the near side wall portion 31 and the far side wall portion 32 respectively by screws or other fixing members, and penetrate through the stacking tray 27 to extend to a lower side over a movable range of the stacking tray 27. On the upper surfaces of the near side wall portion 31 and the far side wall portion 32, there are formed a plurality of mounting holes (screw holes) (not shown). The position of the sheets in the width direction on the stacking tray 27 can be restricted by mounting the side edge restricting members 36 and 37 to the mounting holes at different positions in accordance with sheet sizes. Further, as illustrated in FIG. 4, the trailing edge restricting member 38 is provided to stand so as to be movable along a slide groove 33*a* formed in the bottom plate of the storage unit 25 and penetrates through the stacking tray 27 to extend to an upper side over the movable range of the stacking tray 27. The position of the trailing edge of the sheets in the feeding direction on the stacking tray 27 can be restricted by moving the trailing edge restricting member 38 along the slide groove 33*a* in accordance with sheet sizes.

The lift mechanism 35 (moving unit) is a mechanism configured to raise and lower the stacking tray 27. In the illustrated embodiment, the lift mechanism 35 includes four wires 39, which serve as suspending members fixed to the support parts 27*a* of the stacking tray 27 respectively, and a lift drive mechanism configured to wind up those wires 39. The lift drive mechanism (lift drive unit) includes four winding pulleys 41, which serve as winding members configured to wind up the corresponding wires 39 respectively, and a lift motor (not shown), which serves as a drive source configured to drive a drive shaft to rotate through a plurality of drive gears 43. A plurality of intermediate pulleys 42 are configured to wind up the wires 39 extending between the winding pulleys 41 and the corresponding support parts 27*a*, respectively.

Among the four winding pulleys 41, two winding pulleys 41 are disposed on the side of the near side wall portion 31, and the remaining two winding pulleys 41 are disposed on the side of the far side wall portion 32. The winding pulleys 41 on the side of the near side wall portion 31 and the winding pulleys 41 on the side of the far side wall portion 32 are fixed to the single drive shaft 40 extending along an outer surface of the left side wall portion 29. When the stacking tray 27 is lifted up by the lift mechanism 35, forward driving of the lift motor causes the four winding pulleys 41 to rotate through the drive shaft 40 and wind up the wires 39 respectively, and hence the four support parts 27*a* of the stacking tray 27 are pulled up concurrently. Consequently, the stacking tray 27 is raised while maintaining the substantially horizontal state of the stacking tray 27. Reverse driving of the lift motor causes the four winding pulleys 41 to be driven to rotate in a direction opposite to the direction of rotation for raising and pay out the wires 39, and hence the stacking tray 27 is lowered with the aid of the gravitational force of the stacking tray 27 while maintaining the substantially horizontal state of the stacking tray 27.

In the embodiment, the lift mechanism 35 with the wires 39 is used. However, the lift mechanism 35 is not particularly limited as long as it can raise and lower the stacking tray 27 while maintaining the substantially horizontal state of the stacking tray 27.

The separating and feeding mechanism 26 includes a delivery roller 45 configured to be brought into contact with an uppermost surface of the sheets stacked on the stacking tray 27 to deliver sheets, a separating unit configured to separate the delivered sheets one by one, and a conveyance roller pair 48 configured to convey the sheet separated by the separating unit to the image forming apparatus 2. The separating unit includes a feeding roller 46 and a separating roller 47 which is brought into pressure contact with the feeding roller 46 to prevent the second and subsequent sheets from being fed.

The feeding roller 46 is configured to be driven by a feeding motor (not shown) through a plurality of gears (not shown) and a timing belt (not shown), and driving of the feeding motor causes the feeding roller 46 to rotate and feed the sheet. The delivery roller 45 is rotatably supported by a bracket 49 which is supported so as to be rotatable about a shaft of the feeding roller 46. Rotation of the shaft of the feeding roller 46 by the feeding motor is transmitted to the delivery roller 45 through a plurality of gears to drive the delivery roller 45 to rotate.

The separating roller 47 has a torque limiter (not shown) mounted to its rotation shaft. Accordingly, when two or more overlapping sheets are nipped at a press-contact portion between the feeding roller 46 and the separating roller 47, the separating roller 47 is stopped to prevent the second and subsequent sheets from being fed. In other words, when a plurality of overlapping sheets enter a nip portion between the feeding roller 46 and the separating roller 47, a driving force of the feeding roller 46 is transmitted to the uppermost sheet, whereas rotation of the separating roller 47 is stopped, thereby causing slippage between the uppermost sheet and the second and subsequent sheets from the top, and separating the uppermost sheet from the second and subsequent sheets. As a matter of course, a separating pad or other member may be used in place of the separating roller 47.

The conveyance roller pair 48 includes a driving roller configured to be driven by a conveyance motor (not shown), and a driven roller configured to follow the driving roller to rotate. The conveyance motor (not shown) causes the driving roller to rotate, and hence a sheet is delivered through a delivery port of the feeding apparatus 5 and fed to the image forming apparatus 2.

Next, the pull-out mechanism 24 configured to support the storage unit 25 so as to pull out the storage unit 25 from the housing 23 will be described in detail. For the purpose of loading the stacking tray 27 with sheets, the pull-out mechanism 24 is configured to pull out the storage unit from the housing 23 in a direction (an intersecting direction) intersecting with (in the embodiment, the direction orthogonal to) the feeding direction (the direction in which the sheet is fed from the feeding apparatus 5 to the image forming apparatus 2). In the embodiment, as illustrated in FIG. 2, the pull-out mechanism 24 includes a left side rail pair (first guide unit) 50 serving as a first guide member, which is disposed downstream of the storage unit 25 in the feeding direction and includes an inner rail (slide rail) 50*a* and an outer rail (guide rail) 50*b*, and a right side rail pair (second guide unit) 51 serving as a second guide member, which is disposed upstream of the storage unit 25 in the feeding direction and includes an inner rail (slide rail) 51*a* and an outer rail (guide rail) 51*b*. The inner rails (slide rails) 50*a* and 51*a* are mounted to outer surfaces of the storage unit 25 respectively, which are opposed in the feeding direction, so as to extend parallel to each other, and the outer rails (guide rails) 50*b* and 51*b* are mounted to inner surfaces of the housing 23 of the feeding apparatus 5 respectively, which are opposed in the feeding direction, so as to extend parallel to each other. The inner rails (slide rails) 50*a* and 51*a* mounted to the storage unit 25 are slidably supported by the corresponding outer rails (guide rails) 50*b* and 51*b* mounted to the housing 23. Accordingly, the storage unit 25 can be pulled out along the outer rails (guide rails) 50*b* and 51*b*.

The left side rail pair 50 and the right side rail pair 51 are provided at different height positions rather than at the same height position. In the embodiment, as illustrated in FIG. 2, the left side rail pair 50 is disposed at a position lower than a center position (in other words, a half of the height of the storage unit 25) of the storage unit 25 in a height direction, whereas the right side rail pair 51 is disposed at a position higher than the center position (in other words, the half of the height of the storage unit 25) of the storage unit 25 in the height direction. It is preferred that the left side rail pair 50 and the right side rail pair 51 be disposed at positions equidistantly apart from the center position of the storage unit 25 in the height direction on sides opposite to each other. When the left side rail pair 50 and the right side rail pair 51 are disposed at different heights so that the storage unit 25 is supported in the housing 23 at different height positions on opposed side surfaces of the storage unit 25 as described above, at the time when the storage unit 25 is vacillated (shifted) due to an inertial force, a force which causes rotation opposite to that of the vacillation (shifting) is applied from the housing 23 to the storage unit 25, with the result that the effect of suppressing the vacillation may be exhibited. Moreover, a center of gravity of the storage unit 25 is located near the center of the storage unit 25 in the height direction, and hence arrangement of the left side rail pair 50 and the right side rail pair 51, which receive the force applied from the housing 23 to the storage unit 25, with interposition of the center of the storage unit 25 in the height direction can suppress the vacillation more effectively. Particularly, when the left side rail pair 50 and the right side rail pair 51 are provided at positions equidistant from the center of the storage unit 25 in the height direction on sides opposite to each other, the left side rail pair 50 and the right side rail pair 51 are disposed symmetrically with respect to a position of a substantial center of gravity of the empty storage unit 25, thereby improving the effect of suppressing the vacillation.

Further, as described above, the trailing edge restricting member 38 causes the sheets to be stacked close to the left side wall portion 29 in the storage unit 25. It is preferred that the sheet upper surface detection sensor 28 be disposed at a position close to the sheets to be stacked on the stacking tray 27. Accordingly, in the embodiment, as shown in FIG. 2, the sheet upper surface detection sensor 28 is provided at the upper part of the left side wall portion 29. Moreover, in order to improve the accuracy in controlling the position of the stacking tray 27, it is preferred that the wires 39 be as short as possible to suppress the influence of extension of the wires 39 serving as the suspending members. Therefore, in the embodiment, in order to shorten the length of the wires 39 while taking into account that the cut-out portion 30*a* is formed at an upper part of the right side wall portion 30 as illustrated in FIG. 3, the drive shaft 40 to which the winding pulleys 41 configured to wind up the wires 39 are fixed is disposed below the sheet upper surface detection sensor 28 on the left side wall portion 29 and above the inner rail 50*a* of the left side rail pair 50. In other words, one of the inner rails 50*a* and 51*a* mounted to the storage unit 25 and disposed on a lower side is disposed below the drive shaft 40, a lift motor (not shown) configured to drive the drive shaft 40, and the winding pulleys 41 fixed to the drive shaft 40, and the wires 39 are shortened to improve the accuracy in controlling the position of the stacking tray 27. The inner rail 51*a* of the right side rail pair 51 is provided immediately below the cut-out portion 30*a* of the right side wall portion 30. Accordingly, the inner rail 51*a* exhibits the effect of compensating for deterioration of the strength of the right side wall portion 30 due to formation of the cut-out portion 30*a*.

Figure 5A:
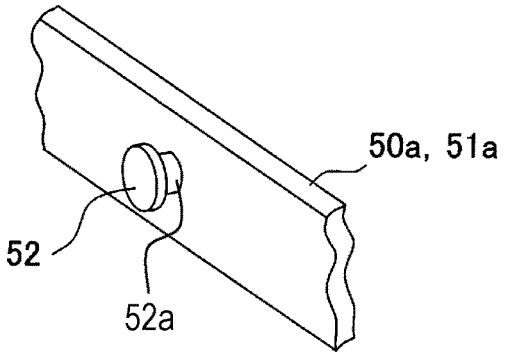
FIG. 5A is a view for illustrating an engagement member provided on an inner rail.
Figure 5B:
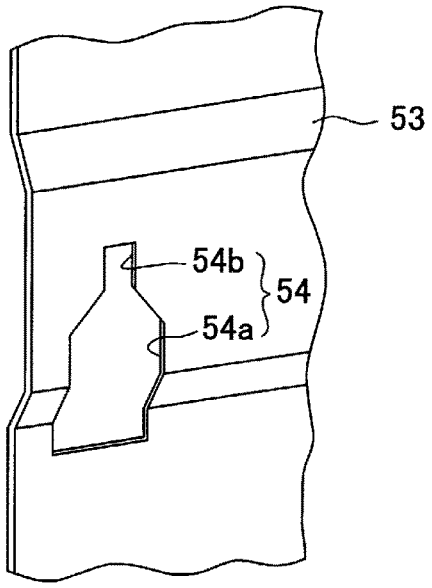
FIG. 5B is a view for illustrating a cut-out hole formed in a mounting portion of the storage unit.
Figure 5C:
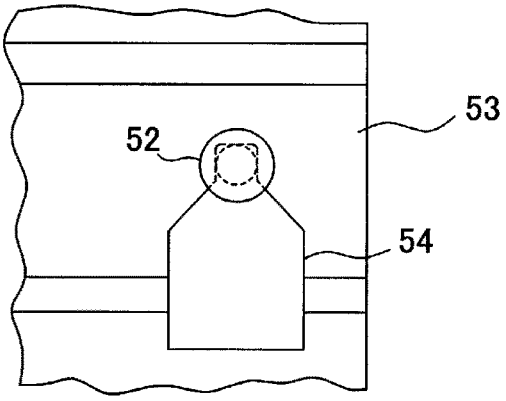
FIG. 5C is a view for illustrating a state in which the inner rail is mounted to the storage unit through engagement of the engagement member to the cut-out hole.
Figure 6:
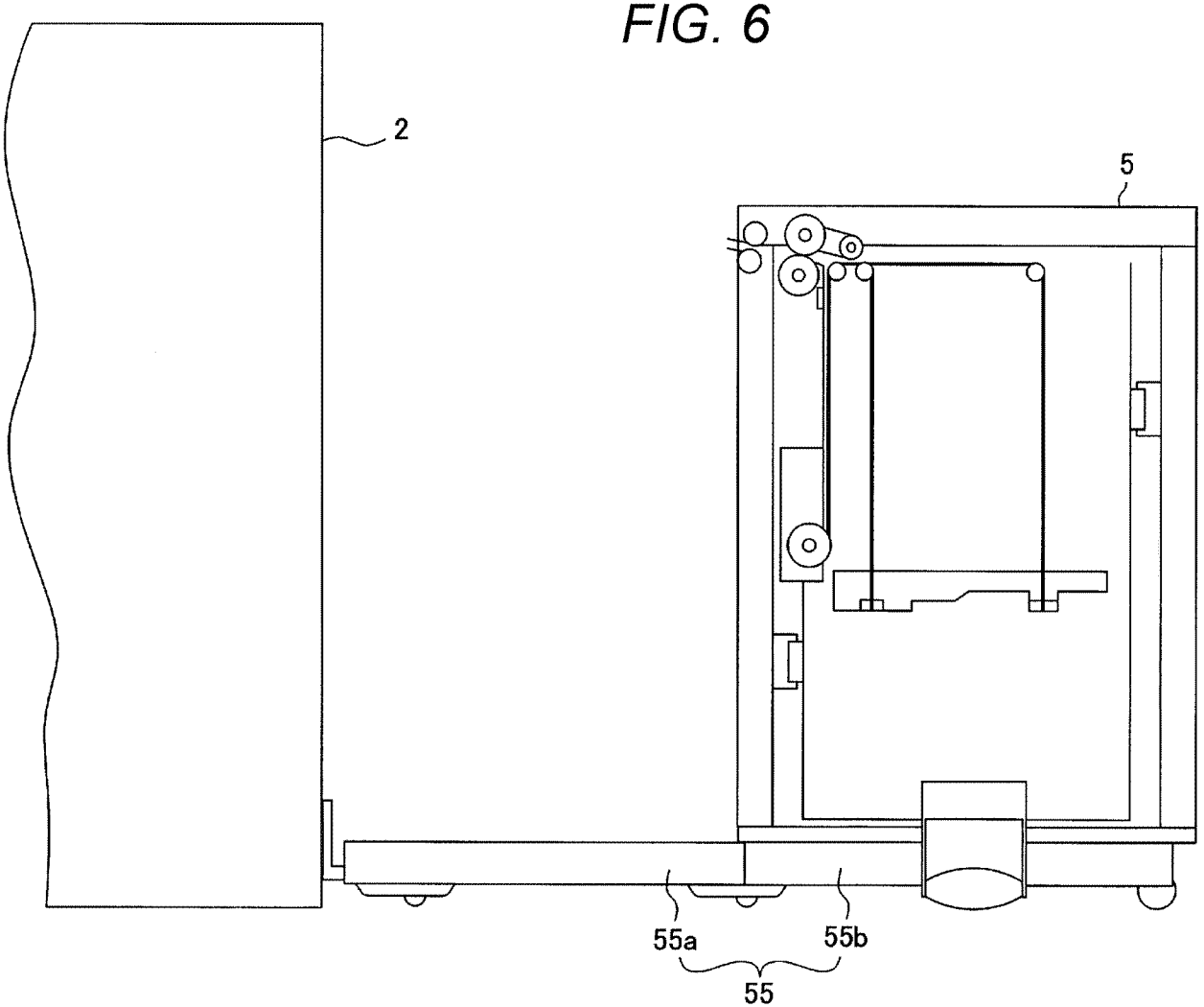
FIG. 6 is an explanatory view for illustrating a moving mechanism configured to move the feeding apparatus with respect to an image forming apparatus in a contactable and separable manner.

It is preferred that the inner rails 50*a* and 51*a* mounted to the storage unit 25 be removably mounted to the storage unit 25 to facilitate maintenance and replacement of components. FIG. 5A, FIG. 5B, and FIG. 5C are explanatory views for illustrating a mechanism for mounting and removing the inner rails 50*a* and 51*a* with respect to the storage unit 25. For example, as illustrated in FIG. 5A, button-shaped engagement members 52 each supported through a neck portion 52*a* may be provided at least at two locations of each of the inner rails 50*a* and 51*a*. In addition, as illustrated in FIG. 5B, cut-out holes 54, which are each formed to have a large hole 54*a* being larger than the engagement member 52 and have a small hole 54*b* extending upward from the large hole 54*a* and being smaller than the engagement member 52 and larger than the neck portion 52*a*, may be formed at positions corresponding to the engagement members 52 in the mounting portions 53 provided on the outer surfaces of the left side wall portion 29 and the right side wall portion 30 of the storage unit 25. After the engagement members 52 of the inner rails 50*a* and 51*a* are inserted to the large holes 54*a* of the cut-out holes 54 of the mounting portions 53 provided on the storage unit 25, the neck portions 52*a* are moved upward toward the small holes 54*b* respectively to engage the engagement portions 52 to the cut-out holes 54 as illustrated in FIG. 5C, thereby being capable of mounting the inner rails 50*a* and 51*a* to the storage unit 25. When the storage unit 25 is to be removed, the storage unit 25 is lifted up with respect to the inner rails 50*a* and 51*a* under a state in which the inner rails 50*a* and 51*a* are engaged with the outer rails 50*b* and 51*b*, and the neck portions 52*a* of the engagement members 52 of the inner rails 50*a* and 51*a* are moved to the large holes 54*a*. After that, the engagement members 52 are pulled off from the large holes 54*a*.

The inner rails 50*a* and 51*a* are engaged with the outer rails 50*b* and 51*b* and supported thereon, and a downward force is applied to the mounting portions 53 by weight of the storage unit 25. Therefore, unintended dropping of the inner rails 50*a* and 51*a* from the mounting portions 53 is less likely to occur. However, the dropping may also be prevented by engaging the inner rails 50*a* and 51*a* with the cut-out holes 54 of the mounting portions 53 and thereafter fixing those by screws.

A moving mechanism is provided at a bottom of the feeding apparatus 5 to facilitate separation of the feeding apparatus 5 from the image forming apparatus 2 in the feeding direction. In the embodiment, as illustrated in FIG.

6, the moving mechanism includes a pair of rail mechanisms 55 which are spaced apart in the sheet width direction and extend parallel to each other, and each rail mechanism 55 includes an inner rail 55*a* and an outer rail 55*b*. The two inner rails 55*a* extending parallel to each other are fixed at their one end portions to the bottom of the image forming apparatus 2 by screws or other fixing tools and installed along a floor surface. The two outer rails 55*b* are mounted so as to extend parallel to each other on inner surfaces of leg portions extending respectively from a front side end portion and a rear side end portion at the bottom of the housing 23 of the feeding apparatus 5. The outer rails 55*b* mounted to the housing 23 of the feeding apparatus 5 are slidably supported by the inner rails 55*a*. With such structure, the feeding apparatus 5 can slide along the inner rails 55*a* in the feeding direction intersecting with the pull-out direction in which the storage unit 25 is pulled out. Thus, when a sheet fed from the feeding apparatus 5 to the image forming apparatus 2 is jammed in a conveyance passage of the image forming apparatus 2, separating the feeding apparatus 5 from the image forming apparatus 2 to open the conveyance passage of the image forming apparatus 2 for the purpose of removing the jammed sheet can be easily performed.

As described above, when the feeding apparatus 5 can be moved by the moving mechanism so as to approach and separate with respect to the image forming apparatus 2 in the feeding direction, at the time of starting or stopping the movement, a force causing the storage unit 25 to shift in the housing 23 of the feeding apparatus 5 is applied due to an inertia force. As in the related art, when the left side rail pair and the right side rail pair serving as the pull-out mechanism 24 are provided at the same height position, the storage unit 25 is in a state of being cantilever-supported by the housing 23 through the left side rail pair and the right side rail pair, and hence the vacillation is likely to occur. In particular, in the case of the housing 23 having a length in the height direction which is longer than a width in the feeding direction, the vacillation of the storage unit 25 is likely to be greater. However, in the feeding apparatus 5, the inner rails 50*a* and 51*a* are mounted so as to extend parallel to each other at different height positions on an outer side of the left side wall portion 29 and the right side wall portion 30, which are opposed to each other, of the storage unit 25, and these inner rails 50*a* and 51*a* are slidably supported by the outer rails 50*b* and 51*b* provided on opposed inner surfaces of the housing 23 respectively. As described above, the inner rails 50*a* and 51*a*, which are supported by the outer rails 50*b* and 51*b* provided in the housing 23, are provided at different height positions. Accordingly, when the vacillation of the storage unit 25 occurs in the housing 23 due to the inertia force at the time of starting or stopping the movement of the feeding device 5, a force in a direction of cancelling out the vacillation is applied from the housing 23 to the storage unit 25 through the outer rails 50*b* and 51*b* and the inner rails 50*a* and 51*a*. Therefore, the vacillation which may occur at the time of starting and terminating the movement of the feeding apparatus 5 upon an operation to manage the sheet jamming and after the sheet jamming clearance is suppressed, thereby being capable of avoiding collision of the storage unit 25 to peripheral components and preventing deformation or damage to components.

Further, when the inner rails 50*a* and 51*a* are removably mounted to the mounting portions 53 provided on the storage unit 25, the inner rails 50*a* and 51*a* which are supported by the outer rails 50*b* and 51*b* provided on opposed inner surfaces of the housing 23 are located at different height positions. The right side rail pair 51 is not provided at a position facing the left side rail pair 50 with interposition of the storage unit 25, and hence a space is secured. Similarly, a space is secured at a position opposed to the right side rail pair 51 with interposition of the storage unit 25. Thus, the storage unit 25 can be easily tilted toward a direction away from the inner rails 50*a* and 51*a*, and hence the operation of mounting and removing the engagement members 52 of the inner rails 50*a* and 51*a* with respect to the cut-out holes 54 of the mounting portions 53 of the storage unit 25 is facilitated.

Moreover, the inner rail 50*a* mounted to the left side wall portion 29 of the storage unit 25 on a side provided with the winding pulleys 41 is disposed at a position lower than the inner rail 51*a* mounted to the right side wall portion 30. Accordingly, the drive shaft 40 and the winding pulleys 41 fixed to the drive shaft 40 can be provided at a relatively high position, thereby being capable of shortening the wires 39 as compared to the case where the winding pulleys 41 are provided below the stacking tray 27, and improving the accuracy in controlling the position of the stacking tray 27. In addition, when the inner rail 50*a* is disposed at a low position, the drive shaft 40, the winding pulleys 41 fixed to the drive shaft 40, and a lift motor (not shown) can be disposed above the inner rail 50*a*. Accordingly, there is no need to provide the winding pulleys 41 and the lift motor below the stacking tray 27, and hence the feeding apparatus 5 can be downsized in the height direction.

The feeding apparatus and the image forming system including the feeding apparatus according to the embodiment are described above. However, the present invention is not limited to the embodiment. For example, in the embodiment, the inner rails 50*a* and 51*a* mounted to the storage unit 25 are slidably supported by the outer rails 50*b* and 51*b* provided in the housing 23. However, it is only necessary that the storage unit 25 be supported in the housing 23 so as to be pulled out from the housing 23, and hence the inner rails 50*a* and 51*a* or the outer rails 50*b* and 51*b* may be replaced with sliders which are configured to slide along another. Moreover, in the embodiment, the inner rails 55*a* of the moving mechanism are connected to the image forming apparatus 2, and the outer rails 55*b* are mounted to the storage unit 25. However, it may also be configured to have the inner rails 55*a* mounted to the storage unit 25, and the outer rails 55*b* connected to the image forming apparatus 2.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-149148, filed Jul. 29, 2015, which is hereby incorporated by reference herein in its entirety.

What is claimed is:

1. A feeding apparatus configured to feed a sheet, the feeding apparatus comprising:

a housing;

a placement unit on which the sheet is placed, the placement unit being movable relative to the housing in an intersecting direction intersecting with a sheet feeding direction, the placement unit being disposed in the housing;

a feeding unit configured to feed the sheet placed on the placement unit in the sheet feeding direction; and a first guide unit and a second guide unit configured to guide the placement unit in the intersecting direction, the first guide unit and the second guide unit being mounted on the housing, the placement unit being movable relative to the first guide unit and the second guide unit, wherein the first guide unit is disposed below the feeding unit and the second guide unit and downstream of the second guide unit in the sheet feeding direction.

2. A feeding apparatus according to claim 1, further comprising a storage unit configured to store the placement unit and the sheet placed on the placement unit, wherein the first guide unit and the second guide unit guide the storage unit in the intersecting direction, wherein the first guide unit is disposed below a center of the storage unit in a height direction, and wherein the second guide unit is disposed above the center.

3. A feeding apparatus according to claim 1, further comprising a storage unit configured to store the placement unit and the sheet placed on the placement unit, wherein the first guide unit and the second guide unit guide the storage unit in the intersecting direction, and wherein the first guide unit and the second guide unit are disposed at positions equidistant from a center of the storage unit in a height direction.

4. A feeding apparatus according to claim 1, further comprising a storage unit configured to store the placement unit and the sheet placed on the placement unit, wherein the first guide unit and the second guide unit guide the storage unit in the intersecting direction, wherein the storage unit is provided with a cut-out portion which is formed in an upper end of the storage unit, and wherein the second guide unit is disposed below the cut-out portion.

5. A feeding apparatus according to claim 1, wherein the feeding apparatus is configured to have a length in a height direction which is longer than a length in the intersecting direction.

6. A feeding apparatus according to claim 1, wherein a placement position of the placement unit on which the sheet is placed is set between the first guide unit and the second guide unit in the sheet feeding direction.

7. A feeding apparatus according to claim 1, wherein the second guide unit is disposed upstream of the feeding unit in the sheet feeding direction.

8. An image forming system comprising:

an image forming apparatus configured to form an image on a sheet; and a feeding apparatus as recited in claim 1, the feeding apparatus configured to feed the sheet to the image forming apparatus.

9. An image forming system according to claim 8, wherein the feeding apparatus is movable relative to the image forming apparatus in a direction in which the feeding apparatus is separated from the image forming apparatus.

10. A feeding apparatus configured to feed a sheet, the feeding apparatus comprising:

a housing;

a placement unit movable in upward and downward directions with the sheet being placed on the placement unit, the placement unit being movable relative to the housing in an intersecting direction intersecting with a sheet feeding direction, the placement unit being disposed in the housing;

a moving unit configured to move the placement unit in an upward direction; and a first guide unit and a second guide unit configured to guide the placement unit in the intersecting direction, the first guide unit and the second guide unit being mounted on the housing, the placement unit being movable relative to the first guide unit and the second guide unit, wherein the first guide unit is disposed below the moving unit and the second guide unit and downstream of the second guide unit in the sheet feeding direction.

11. A feeding apparatus according to claim 10, wherein the moving unit is a winding member which is configured to wind up a suspending member which suspends the placement unit.

12. A feeding apparatus according to claim 11, further comprising a feeding unit configured to feed the sheet placed on the placement unit in the sheet feeding direction, wherein the winding member is disposed below the feeding unit.

13. A feeding apparatus according to claim 10, further comprising a storage unit configured to store the placement unit and the sheet placed on the placement unit, wherein the first guide unit and the second guide unit guide the storage unit in the intersecting direction, wherein the first guide unit is disposed below a center of the storage unit in a height direction, and wherein the second guide unit is disposed above the center.

14. A feeding apparatus according to claim 10, further comprising a storage unit configured to store the placement unit and the sheet placed on the placement unit, wherein the first guide unit and the second guide unit guide the storage unit in the intersecting direction, and wherein the first guide unit and the second guide unit are disposed at positions equidistant from a center of the storage unit in a height direction.

15. A feeding apparatus according to claim 10, further comprising a storage unit configured to store the placement unit and the sheet placed on the placement unit, wherein the first guide unit and the second guide unit guide the storage unit in the intersecting direction, wherein the storage unit is provided with a cut-out portion which is formed in an upper end of the storage unit, and wherein the second guide unit is disposed below the cut-out portion.

16. A feeding apparatus according to claim 10, wherein the feeding apparatus is configured to have a length in a height direction which is longer than a length in the feeding direction.

17. A feeding apparatus according to claim 10, wherein a placement position of the placement unit on which the sheet is placed is set between the first guide unit and the second guide unit in the sheet feeding direction.

18. A feeding apparatus according to claim 10, wherein the second guide unit is disposed upstream of the moving unit in the sheet feeding direction.

19. An image forming system comprising:

an image forming apparatus configured to form an image on a sheet; and a feeding apparatus as recited in claim 10, the feeding apparatus configured to feed the sheet to the image forming apparatus.

20. An image forming system according to claim 19, wherein the feeding apparatus is movable relative to the image forming apparatus in a direction in which the feeding apparatus is separated from the image forming apparatus.

* * * * *